US005457259A

United States Patent [19]

Elgarhy et al.

[11] Patent Number: 5,457,259

[45] Date of Patent: Oct. 10, 1995

[54] POLYAMIDE MATERIALS WITH DURABLE STAIN RESISTANCE

[75] Inventors: Yassin M. Elgarhy, St. Eustache; Barry R. Knowlton, Concord, both of Canada

[73] Assignee: Trichromatic Carpet Inc., Quebec, Canada

[21] Appl. No.: 190,636

[22] Filed: Feb. 2, 1994

[51] Int. Cl.[6] ..... C08L 61/06; C08L 61/14; C08L 77/02; C08L 77/04

[52] U.S. Cl. ..... 428/224; 428/267; 428/287; 428/474.4; 428/475.5; 428/477.4; 525/427; 525/480; 525/505; 525/538

[58] Field of Search ..... 428/267, 224, 428/287, 474.4, 475.5, 477.4; 525/427, 505, 480, 538

[56] References Cited

U.S. PATENT DOCUMENTS

| | | | |
|---|---|---|---|
| 4,501,591 | 2/1985 | Ucci et al. | 8/495 |
| 4,592,940 | 6/1986 | Blyth et al. | 428/96 |
| 4,680,212 | 7/1987 | Blyth et al. | 428/97 |
| 4,780,099 | 10/1988 | Greschler et al. | 8/115.6 |
| 4,822,373 | 4/1989 | Olson et al. | 8/115.6 |

*Primary Examiner*—W. Robinson Clark
*Attorney, Agent, or Firm*—Bauer & Schaffer

[57] ABSTRACT

A treated fibrous polyamide substrate having durable resistance to staining by acid colorants comprising a fibrous polyamide substrate having applied thereto an aqueous solution of a partially sulfonated, partially phosphated resol resin; which aqueous solution may include polymethylmethacrylates or combinations thereof, and that may include a fluorochemical; and the method of treating said substrate, and the resol resins themselves.

13 Claims, No Drawings

POLYAMIDE MATERIALS WITH DURABLE STAIN RESISTANCE

FIELD OF INVENTION AND PRIOR ART

Fibrous polyamide substrates, such as nylon carpeting are susceptible to staining by both naturally occurring and commercial acid colorants found in many common foods and beverages. The demand for reduced staining from such acid colorants has by and large been met by treatment with compositions comprising sulfonated naphthol- and/or sulfonated phenol-formaldehyde condensation products as disclosed for example in the following patents: U.S. Pat. No. 4,501,591 (Ucci and Blyth); U.S. Pat. No. 4,592,940 (Blyth and Ucci); U.S. Pat. No. 4,680,212 (Blyth and Ucci); and U.S. Pat. No. 4,780,099 (Greschler, Malone and Zinnato); or by treatment with compositions comprising sulfonated novolak resins together with polymethacrylic acid as disclosed in U.S. Pat. No. 4,822,373 (Olson, Chang and Muggli).

The initial stain resistant properties imparted to polyamide substrates, such as carpeting, that have been treated using the above mentioned compositions degenerate significantly with each wet cleaning the substrate receives. Improved stain resistance after wet cleaning can be achieved by increasing the amount of stain-resist product initially applied to the substrate. However, this generally leads to discoloration caused by yellowing of the substrate initially, and further discloloration results following exposure to oxides of nitrogen and/or light. This discoloration in most cases is attributed to dihydroxydiphenyl sulfone and its associated $SO_2$ group.

Stain-resist products currently available in the market place are generally novolak-type resins based on dihydroxydiphenyl sulfone condensed with phenol sulfonic acid or naphthalene sulfonic acid and an aldehyde in various proportions. The chemical structure of these resins may generally be depicted as follows:

(a) Condensation product of naphthalene sulfonic acid and dihydroxydiphenyl sulfone with formaldehyde

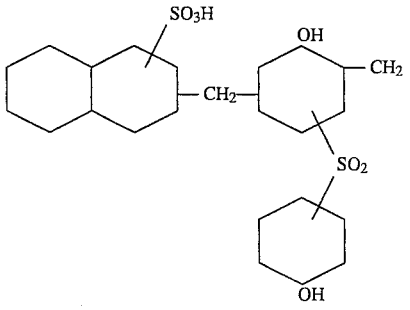

(b) Condensation product of phenolsulfonic acid and dihydroxydiphenol sulfone with formaldehyde

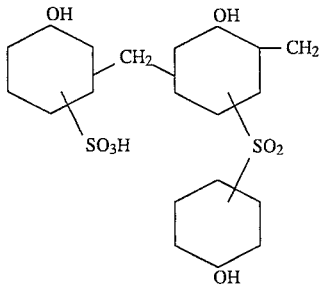

It is generally known that increasing the ratio of dihydroxydiphenol sulfone to phenol sulfonic acid or naphthalene sulfonic acid will increase the stain resist properties of the resin and subsequently cause a higher degree of yellowing or discoloration initially and further discoloration upon exposure to oxides of nitrogen and/or light. It is also evident that when the ratio of phenol sulfonic acid or naphthalene sulfonic acid to dihydroxydiphenyl sulfone is increased, the result is lowered stain-resist properties and less discoloration.

The addition of acrylic polymers and/or copolymers to the previously mentioned condensation products, as disclosed in U.S. Pat. No. 4,822,373 (Olson, Chang and Muggli), allows the use of a novolak resin condensate containing a high ratio of dihydroxydiphenol sulfone without adverse discoloration. This is achieved due to the dramatically reduced percentage of novolak resin in the product which is adjusted to obtain a desired maximum level of discoloration while maintaining a minimum level of durable stain resistance. The high level of initial stain resistance is supplied primarily by the acrylic polymers and/or copolymers and, after wet cleaning stain resistance is maintained by the novolak resin condensate, the acrylics having largely been removed during the wet cleaning process.

The novel compositions developed according to the present invention, that is to say, the partially phosphated partially sulfonated resol resins supplemented if desired by the addition of a polymer or copolymer of a polymethylmethacrylate and/or a fluorochemical, when applied to fibrous polyamide substrates provide substrates that exhibit superlative resistance to staining by acid colorants, stain-resistant qualities that are not significantly impaired following repeated washing. It is to be noted too that the novel compositions according to the invention tend to minimize discoloration of the fibrous polyamide substrates both during manufacture and subsequently following exposure either to oxides of nitrogen or light.

The novel stain-blocking resin compositions according to the invention differ materially from stain-blockers of the prior art, many of which, as has been mentioned, rely on use of partially sulfonated novolak resins. The new resins are in fact resol resins heretofore unknown in the art, and are lighter in color than prior art novolak resins.

The series of reactions terminating in the preparation of the partially sulfonated and phosphated resins according to the invention runs as follows: condense phenol and sulphonated naththalene in the presence of an aldehyde, preferably formaldehyde, in an alkaline medium, pH 9 to 10. Following the formaldehyde condensation the pH of the medium is adjusted to between 4 to 5, and a sulfonating agent such as sodium metabisulfite ($Na_2S_2O_5$) is added. The reaction leading to partial sulfonation of the phenol is continued for 1 to 2 hours at 105° C. The reaction mixture is then cooled to 50° C. phosphoric acid ($H_3PO_4$) is added, the temperature is raised to 90° to 105° C. and the phosphating reaction is continued for 1 to 2 hours.

The ratio of sulfonated naphthalene to phenol initially is between 0 and 40 percent, preferably 10 to 25 percent, sulfonated naphthalene to 75 to 90 percent phenol, while the ratio of formaldehyde should be at least one mole of phenol to one mole HCHO, and may be 1.3:1.

The sulfonated naphthalene employed at the initial stage of the reaction may be any one of three naphthalene derivatives, namely, either the 1-, 2-, or 3- monosulfonic acid derivatives with the 2-monosulfonic derivative being preferred.

Sufficient $H_3PO_4$ is employed to assure between 5 and 15 percent, preferably 10 percent phosphation. Following phosphation an alkaline solution is added to adjust the pH to between 5 and 6 and the solids content to between 30 and 40 percent, the alkali used being either sodium or potassium hydroxide.

The product is yellow to light brown in color, the color tending to darken on exposure to light or air, or to oxides of nitrogen, but color may be stabilized by the addition of a small amount of sodium formaldehyde-H-sulfoxylate, $NaHSO_2.HCHO.2H_2O$, at a pH below 7 and a temperature below 90° C. for 20 to 60 minutes, preferably 30 minutes, the quantity of the sulfoxylate being 0.1 to 4.0 percent, preferably 0.5 to 2.0 percent. The sulfoxylate treatment reduces color by 20 to 50 percent and prevents further discoloration.

The reaction scheme according to the invention may generally but without undue restriction be graphically illustrated as follows:

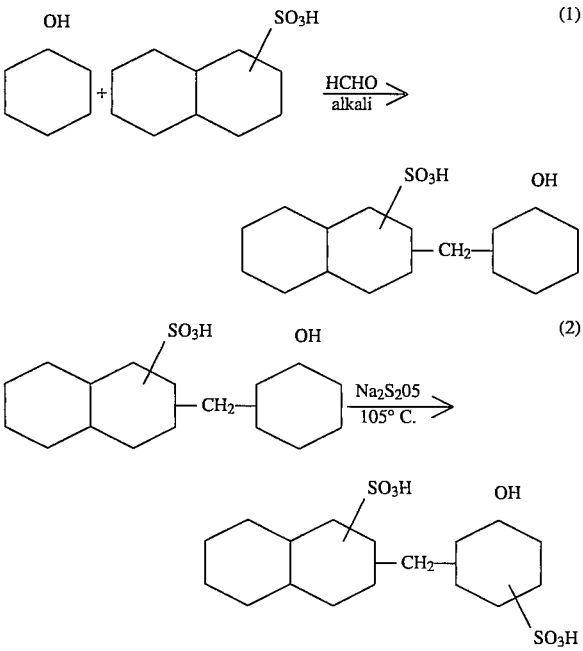

-continued

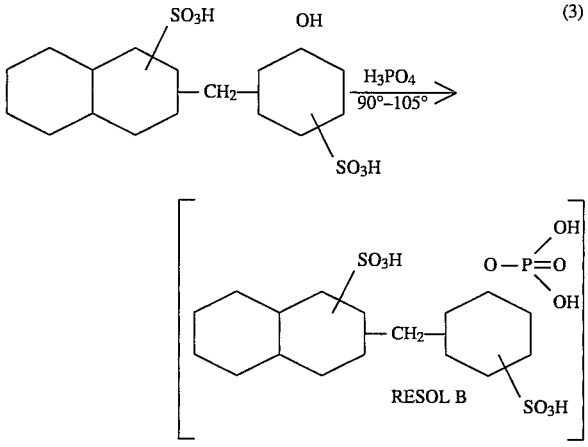

In the foregoing reaction the ratios of naphthalene sulfonic acid to phenol are 1 to 40 percent naphthalene sulfonic acid to 60 to 99 percent phenol.

Where phenol alone is used without naphthalene sulfonic acid the phosphated structure should be

RESOL A

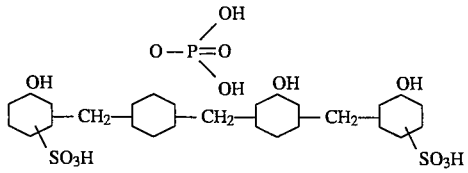

Additional structures that may be obtained during the reactions are as follows:

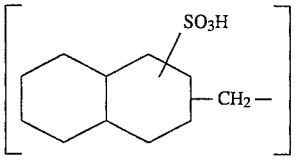

(I)

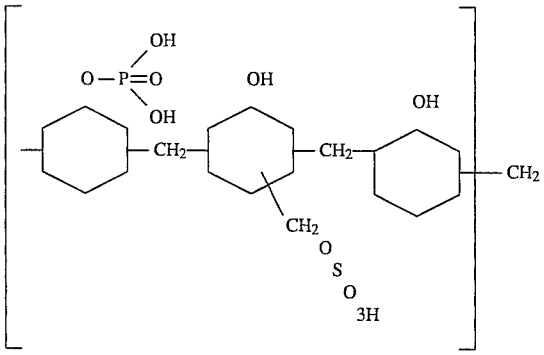

II or

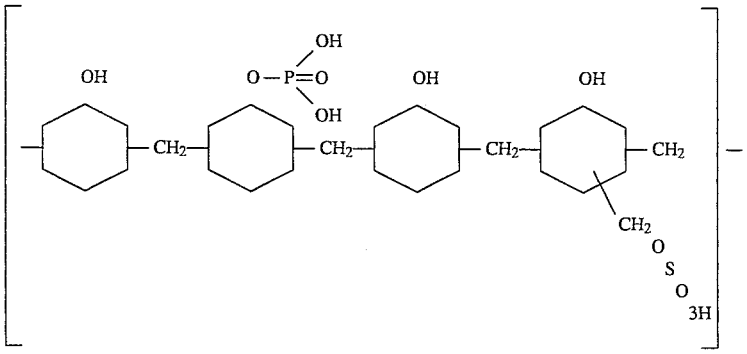

0

SUMMARY OF THE INVENTION

The present invention provides fibrous polyamide substrates, which exhibit improved resistance to staining by acid colorants after washing with detergent, that have had applied thereto a composition comprising a partially phosphated, partially sulfonated resol resin. That combination may include methyacrylates such as polymers, and copolymers of polymethylmethacrylates or combinations thereof and may include a flurochemical.

Generally the resol products of this invention are applied to the polyamide substrate from an aqueous solution at a pH below 5 after the dyeing process. The resol products may be applied from an aqueous exhaust bath or by continuous application methods such as padding, foam, flooding or spray; all of which are well known to those skilled in the art.

Fluorochemical compositions for providing oil, water and soil repellency can also be applied in conjunction with the resol products of this invention.

Polymethylmethacrylates may also be applied in conjunction with the resol resins of this invention to further reduce or eliminate any likelihood of initial yellowing or of discoloration upon exposure to light or discoloration upon exposure to oxides of nitrogen.

TEST METHODS

In the test procedures and examples described below all percentages are by weight unless otherwise indicated.

INITIAL STAIN ESISTANCE ("IS")

A 5"×5" sample of the substrate to be tested is placed on a flat, non-absorbent surface. A two inch ring is placed on the sample and 20 ml of staining solution is poured into the ring and worked into the substrate. The ring is removed and the sample is left undisturbed for 24 hours at ambient temperature. The staining solution is prepared by dissolving 45 grams of cherry flavored "Kool Aid" (trade mark), sugar-sweetened in 500 ml of water at 20° C. After 24 hours the sample is rinsed with cool tap water and dried.

The stain resistance of the sample is visually rated by assessing the amount of color remaining in the stained area by comparison with the unstained portion. The sample is rated on a scale from 1 to 8 wherein 8 is excellent stain resistance and 1 is poor stain resistance categorized as follows:

8= excellent stain resistance
7= good stain resistance
6= poor stain resistance
5= unacceptable staining
4= unacceptable staining
3= unacceptable staining
2= unacceptable staining
1= unacceptable staining

AFTER WET CLEANING STAIN RESISTANCE ("W.S.")

The sample to be tested is first immersed in a detergent solution containing 15 grams of "Dupanol WAQE" per liter of water at a pH of 10 and at 20° C. for 15 minutes. The sample is removed from the deterrent solution and rinsed thoroughly with cool tap water and dried. The staining solution is then applied and evaluated as set out in the initial stain resistance procedure.

INITIAL YELLOWING (DISCOLORATION) EVALUATION ("ID")

In the examples a graduated scale from 1 to 5 was used to evaluate yellowing where 5 represents no yellowing, 4 represents acceptable yellowing, and 3 or less represents unacceptable yellowing.

DISCOLORATION UPON EXPOSURE TO LIGHT ("LD")

In the examples a graduated scale from 1 to 5 was used to evaluate discoloration upon exposure to light where 5 represents no discoloration, 4 represents acceptable discoloration, and 3 or less represents unacceptable discoloration. Exposure to light was carried out according to AATCC test methods with an exposure time of 40 standard hours.

DISCOLORATION UPON EXPOSURE TO NITROUS OXIDES ("NO")

In the examples testing was performed according to AATCC test method 164-1992 and evaluated according to the number of test cycles completed by each sample before a gray scale rating of 4 was reached where the maximum number of cycles was 3. Thus a 3 cycle rating is superior to a 2 cycle rating and a 2 cycle rating is superior to a 1 cycle rating.

The following resol resins where prepared according to the preceding general disclosure for use in examples of this invention.

Resol "A"— Based on 18% phenol

Resol "B"—Based on 16%A phenol and 2% naphthol

Resol resins combined with polymethylmethacrylates used in examples of this invention are of the following composition.

Resol 'A'/Acrylic "A"—55% by weight resol A combined with 45% by weight polymethylmethacrylates of 250, 000 to 500,000 M.W.

Resol 'A'/Acrylic "B"—55% by weight resol A combined with 45% by weight polymethylmethacrylates of 40,000 to 80,000 M.W.

Resol 'A'/Acrylic "C"—55% by weight resol A combined with 45% by weight polymethylmethacrylates of 2,000 to 10,000 M.W.

Resol 'A'/Acrylic "D"—55% by weight resol A combined with 15% by weight polymethylmethacrylates of 250, 000 to 500,000 M.W. 15% by weight polymethylmethacrylates of 40,000 to 80,000 M.W. 15% by weight polymethylmethacrylates of 2,000 to 10,000

Resol 'B'/Acrylic "A"—55% by weight resol B combined with 45% by weight polymethylmethacrylates of 250, 000 to 500,000 M.W.

Resol 'B'/Acrylic "B"—55% by weight resol B combined with 45% by weight polymethylmethacrylates of 40,000 to 80,000 M.W.

Resol 'B'/Acrylic "C"—55% by weight resol B combined with 45% by weight polymethylmethacrylates of 2,000 to 10,000 M.W.

Resol 'B'/Acrylic "D"—55% by weight resol B combined with 15% by weight polymethylmethacrylates of 250, 000 to 500,000 M.W. 15% by weight polymethylmethacrylates of 40,000 to 80,000 M.W. 15% by weight polymethylmethacrylates of 2,000 to 10,000 M.W.

Commercially available stain resist products used for comparison with the products of the present invention are designated as follows:

Comparative stain resist A—FX661: a novolak, acrylic blend available from 3M Co.

Comparative stain resist B—FX369: a novolak resin available from 3M.

Comparative stain resist C—Algard DP3 4694: a novolak resin available from Allied Colloids Inc.

The nylon 6 and 66 substrates used in examples of this invention were in cut pile carpel form that was processed through a dyeing cycle without dyestuffs being present so as to yield an uncolored substrate free of fibre lubricating oils. These substrates are designated as follows:

Nylon 66—Monsanto fibre type 1837, moist heat set

Nylon 6—BASF fibre, moist heat set

EXAMPLE 1

A treating solution was prepared containing 2.0% resol A based on the nylon 66 sample weight of 15 grams and exhausted onto the fibre at a liquor ratio of 15:1, at a pH of 2.5 and at 75° C. for a period of 20 minutes. The sample was then rinsed and dried.

EXAMPLE 2

A treating solution was prepared containing 4.0% resol A based on the nylon 6 sample weight of 15 grams and exhausted onto the fibre at a liquor ratio of 15:1 at a pH of 2.5 and at 75° C. for a period of 20 minutes. The sample was rinsed and dried.

EXAMPLE 3

A nylon 66 sample was prepared as in Example 1 except that 2.0% of resol B replaced resol A.

EXAMPLE 4

A nylon 6 sample was prepared as in Example 2 except that 4% of resol B replaced resol A.

EXAMPLE 5

A nylon 66 sample was prepared as in Example 1 except that 2% comparative stain resist B replaced resol A.

EXAMPLE 6

A nylon 6 sample was prepared as in Example 2 except that 4% comparative stain resist B replaced resol A.

EXAMPLE 7

A nylon 66 sample was prepared as in Example 1 except that 2% comparative stain resist C replaced resol A.

EXAMPLE 8

A nylon 6 sample was prepared as in Example 2 except that 4% comparative sample C replaced resol A.

Examples 1 through 8 were evaluated for initial stain resistance (IS) after wet cleaning stain resistance (WS), initial discoloration (ID), discoloration upon exposure to light (LD), and oxides of nitrogen (NO), the results being set forth in Table 1. t,150

As can be seen from the data in Table 1, the polyamide substrates treated with resol resins of this invention (examples 1 to 4) generally demonstrate a higher initial stain resistance and stain resistance after wet cleaning than comparative resins (examples 5 to 8). It is also apparent that certain novolak resins, although demonstrating inferior to unacceptable stain resistance, do exhibit less discoloration initially and upon exposure to light (examples 7 & 8). The resol resins of this invention (examples 1 to 4) also demonstrate equivalent or less discoloration upon exposure to oxides of nitrogen with respect to comparative novolak resins (examples 5 to 8).

EXAMPLE 9

A treating solution was prepared containing 4.0% resol A/Acrylic A blend based on a nylon 6 sample weight of 15 grams and exhausted onto the fibre at a liquor ratio of 15:1 at a pH of 2.5 and at a temperature of 75° C. for a period of 20 minutes. The sample was rinsed and dried.

In examples 10 through 17, nylon 6 samples were prepared and treated as in Example 9 except the stain resist compounds used were as set forth in Table 2. t,160

Examples 9 through 17 were evaluated for initial stain resistance, after wet cleaning stain resistance, initial discoloration, discoloration upon exposure to light and oxides of nitrogen, the results being set forth in Table 3. t,170

As can be seen from the data in Table 3, the polyamide substrate treated with resol resins of this invention combined with polymethylmethacrylates (Examples 9 to 16) demonstrate significant improvements in initial discoloration, discoloration upon exposure to light and oxides of nitrogen when compared to the uncombined resol resins of Examples 1 to 4. It is also apparent that resol resins combined with polymethylmethacrylates of this invention (Examples 9 to 16) exhibit lower stain resistance ratings after wet cleaning as compared to the uncombined resol resins of Examples 1 to 4. Resol resins of this invention combined with polymethylmethacrylates in Examples 9 through 16 in all examples demonstrate superior or equal properties to comparative sample 17 which is a novolak resin combined with acrylic polymer.

For Examples 18 and 19 resol resin A was combined with polymethylmethacrylate blends as follows:

EXAMPLE 18

Resol 'A'/Acrylic "E"—25% by weight resol "A" combined with

25% by weight polymethylmethacrylates of 250,000 to 500,00 M.W.

25% by weight polymethylmethacrylates of 40,000 to 80,000 M.W.

25% by weight polymethylmethacrylates of 2,000 to 10,000 M.W.

EXAMPLE 19

Resol 'A'/Acrylic "F"—70% by weight resol "A" combined with

10% by weight polymethylmethacrylates of 250,000 to 500,000 M.W.

10% by weight polymethylmethacrylates of 40,000 to 80,000 M.W.

10% by weight polymethylmethacrylates of 2,000 to 10,000 M.W.

In Example 18, a treating solution was prepared containing 4.0% resol 'A'/acrylic "E" blend, as previously described, based on a nylon 6 sample weight of 15 grams and exhausted onto the fibre at a liquor ratio of 15:1 at a pH of 2.5 and at a temperature of 75° C. for a period of 20 minutes, the sample was rinsed and dried.

Example 19 was prepared and treated as in Example 18 except the stain resist resol 'A'/acrylic "F" blend as previously described was used to replace stain resist resol 'A'/acrylic "E" blend.

Examples 18 and 19 were tested and reported in Table 4 along with data from Examples 2, 12 and 17 for comparative purposes. t,190

As can be seen from the data in Table 4, the polyamide substrates of Examples 18, 19 and 12 treated with resol resin containing various proportions of polymethylmethacrylates of blended molecular weights exhibited superior stain resistance after wet cleaning when compared to the novolak/acrylic of comparative Example 17 and inferior stain resistance after wet cleaning when compared to 100% resol "A" of Example 2. Furthermore the blended resol/acrylics of Examples 12 and 18 exhibited superior performance upon exposure to nitrous oxides when compared with the comparative novolak/acrylic blend of Example 17. It is also noted that when the proportion of polymethylmethacrylates present in the resol resin in approximately a ratio of 1:1 as in Example 12 optimum results are obtained with respect to stain resistance after wet cleaning, initial discoloration and discoloration upon exposure to light and oxides of nitrogen when compared to comparative example 17.

Comparisons of Examples 2, 12, 18 and 19 demonstrate that as the concentration of resol resin to polymethylmethacrylates is reduced a) the stain resistance after wet cleaning is reduced and b) the propensity for discoloration from tested sources is also reduced.

EXAMPLE 20

A treating solution containing 75 g/L. Resol 'A'/Acrylic 'D' blend and 50 g/L Milease™ F15N, a non ionic fluorochemical available from I.C.I., U.S.A. plus 20 g/L. Alkafoam D, a foaming agent available from Alkaril Chemicals, Inc., and having a pH of 4 using acetic acid was prepared and foamed onto a sample of nylon 66 carpet using a blow ratio of 60:1 and a wet pick up of 20% to provide an application rate of 1.5% Resol 'A'/Acrylic 'D' plus 1% fluorchemical based on the weight of the sample. The sample was dried at 120° C. for 20 minutes. The treated sample was tested with results as set forth in Table 5 along with results from Example 12 Resol 'A'/Acrylic 'D' without fluorochemical. t,200

Example 18 containing Resol 'A'/Acrylic 'D' and a fluorochemical demonstrated no adverse affects due to the presence of fluorochemical when compared with Example 12 which did not contain a fluorochemical. It should be noted that less stain resist chemical is required when directly applied to the substrate via foam methods, when compared to indirect application via exhaust methods.

EXAMPLE 21

A treating solution containing 75 g/L Resol resin B and 50 g/l of Milease™ F15N a non ionic fluorochemical available from I.C.I., U.S.A. plus 20 g/L Alkafoam D, a foaming agent available from Alkaril Chemicals, and having a pH of 4 using acetic acid was prepared and foamed onto a sample of nylon 66 carpet using a blow ratio of 60:1 and a wet pick up of 20% to provide an application rate of 1.5% resol resin 'B' plus 1% fluorochemical based on the weight of the sample. The sample was dried at 120° C. for 20 minutes. The treated sample was tested with results as set forth in Table 6 along with results from Example 3 Resol 'B' containing no fluorochemical. t,210

Example 21 containing Resol 'B' Resin and a fluorochemical demonstrated no adverse affects due to the presence of a fluorochemical when compared with example #3 containing only Resol Resin 'B'. It should be noted that less stain resist chemical is required when directly applied to the substrate via foam methods when compared to indirect application via exhaust methods.

We claim:

1. A treated fibrous polyamide substrate having durable resistance to staining by acid colorants, having applied thereto a partially sulfonated, partially phosphated resol resin.

2. The invention according to claim 1, the resol resin being one of the group: (1) a partially sulfonated, partially phosphated aldehyde condensation product of phenol and sulfonated naphthalene; (2) a partially sulfonated, partially phosphated phenol aldehyde condensation product.

3. The invention according to claim 2, the aldehyde being formaldehyde.

4. The invention according to claim 2, the sulfonated naphthalene being selected from the group: the 1-, 2-, and 3-monosulfonic acid derivatives.

5. The invention according to claim 4, the sulfonated naphthalene being the 2-monosulfonic acid derivative.

6. The invention according to claim 2, the resol resin being the phenol formaldehyde condensation product, the phenol being both partially sulfonated and partially phosphated.

7. The invention according to claim 2, the resol resin being a formaldehyde condensation product of phenol and sulfonated naphthalene, the phenol being partially phosphated.

8. The invention according to claim 3, the substrate material being polyamide, the resol resin being present in an amount of at least 0.1 to 5.0 percent, based on the weight of the fabric.

9. The invention according to claim 8, the resol resin being present in the amount of 1.0 to 4.0 percent based on the weight of the fabric.

10. The method of treating a fibrous polyamide substrate, to render it durably resistant to staining by acid colorants; comprising applying to the substrate material a solution comprising a partially sulfonated, partially phosphated resol resin.

11. The method according to claim 10, the resol resin being an aldehyde condensation product of phenol and a partially sulfonated naphthalene.

12. The method according to claim 11, the resol resin being a formaldehyde condensation product, at least one phenolic element of which being phosphated.

13. The method according to claim 12, the resol resin being the formaldehyde condensation product of a substance selected from the group: phenol and phenol in admixture with a sulfonated naphthalene.

* * * * *